US010226923B2

(12) United States Patent
Kimura et al.

(10) Patent No.: US 10,226,923 B2
(45) **Date of Patent: *Mar. 12, 2019**

(54) PRINTER

(71) Applicant: BROTHER KOGYO KABUSHIKI KAISHA, Nagoya-shi, Aichi-ken (JP)

(72) Inventors: Aya Kimura, Nagoya (JP); Shin Hasegawa, Nagoya (JP); Masashi Ueda, Nagoya (JP)

(73) Assignee: BROTHER KOGYO KABUSHIKI KAISHA, Nagoya-Shi, Aichi-Ken (JP)

( * ) Notice: Subject to any disclaimer, the term of this patent is extended or adjusted under 35 U.S.C. 154(b) by 0 days.

This patent is subject to a terminal disclaimer.

(21) Appl. No.: 15/470,264

(22) Filed: Mar. 27, 2017

(65) Prior Publication Data

US 2018/0072050 A1 Mar. 15, 2018

(30) Foreign Application Priority Data

Sep. 9, 2016 (JP) ..... 2016-176742

(51) Int. Cl.
*B41J 2/045* (2006.01)
*B41J 2/21* (2006.01)

(52) U.S. Cl.
CPC ..... *B41J 2/04563* (2013.01); *B41J 2/0454* (2013.01); *B41J 2/04551* (2013.01);
(Continued)

(58) Field of Classification Search
CPC ..... B41J 2/004563; B41J 2/04581; B41J 2/04573; B41J 2/0454; B41J 2/04551; B41J 2/04553
See application file for complete search history.

(56) References Cited

U.S. PATENT DOCUMENTS

2003/0133492 A1 7/2003 Watanabe
2007/0140771 A1 6/2007 Yanagi
(Continued)

FOREIGN PATENT DOCUMENTS

JP 2002-225238 A 8/2002
JP 2009-297968 A 12/2009
(Continued)

OTHER PUBLICATIONS

Related U.S. Appl. No. 15/470,428, filed Mar. 27, 2017.
(Continued)

*Primary Examiner* — Kristal Feggins
*Assistant Examiner* — Kendrick Liu
(74) *Attorney, Agent, or Firm* — Scully, Scott, Murphy & Presser, P.C.

(57) ABSTRACT

A liquid ejection head has a plurality of nozzles and has a plurality of drive elements configured to cause the plurality of nozzles to eject liquid. A temperature sensor is configured to detect a temperature of the liquid ejection head. A heat generator generates heat when the plurality of drive elements is driven. A controller is configured to: perform a determining process of determining, based on a particular parameter indicative of a temperature difference, whether the printer is in a first state where the temperature difference is constant or in a second state where the temperature difference varies with time, the temperature difference being a temperature difference between the temperature detected by the temperature sensor and an actual temperature of the liquid ejection head; and control the plurality of drive elements based on a determination result in the determining process.

17 Claims, 12 Drawing Sheets

(52) U.S. Cl.
CPC ..... *B41J 2/04553* (2013.01); *B41J 2/04573* (2013.01); *B41J 2/04581* (2013.01); *B41J 2/2135* (2013.01)

(56) References Cited

U.S. PATENT DOCUMENTS

| | | | | |
|---|---|---|---|---|
| 2010/0156977 | A1* | 6/2010 | Kanematsu | B41J 19/145 347/14 |
| 2011/0249053 | A1* | 10/2011 | Makita | B41J 2/04516 347/17 |
| 2012/0194591 | A1 | 8/2012 | Hagiwara | |
| 2012/0249639 | A1* | 10/2012 | Ozawa | B41J 2/04563 347/10 |
| 2018/0072081 | A1* | 3/2018 | Kimura | B41J 29/393 |

FOREIGN PATENT DOCUMENTS

| | | | |
|---|---|---|---|
| JP | 2012-158140 | A | 8/2012 |
| JP | 2016-043634 | A | 4/2016 |

OTHER PUBLICATIONS

U.S. Office Action dated Jul. 20, 2018 received in related U.S. Appl. No. 15/470,428.
Notice of Allowance dated Dec. 26, 2018 received in related U.S. Appl. No. 15/470,428.

* cited by examiner

| | Te<Te1 | Te1≤Te<Te2 | Te≥Te2 |
|---|---|---|---|
| ΔT2<ΔT21 | U11 | U12 (<U11) | U13 (<U12) |
| ΔT21≤ΔT2<ΔT22 | U21 (<U11) | U22 (<U12, U21) | U23 (<U13, U22) |
| ΔT2≥ΔT22 | U31 (<U21) | U32 (<U22, U31) | U33 (<U23, U32) |

PRINTER

CROSS REFERENCE TO RELATED APPLICATIONS

This application claims priority from Japanese Patent Application No. 2016-176742 filed Sep. 9, 2016. The entire content of the priority application is incorporated herein by reference.

TECHNICAL FIELD

This disclosure relates to a printer that performs printing by ejecting liquid from nozzles.

BACKGROUND

An inkjet printer as an example of a printer is known that performs printing by ejecting liquid from nozzles. The inkjet printer is a so-called a serial type and can perform bidirectional printing. When printing is performed, ejection timing in the bidirectional printing is determined depending on the temperature detected by a temperature sensor. Thereby, deviation of droplet landing positions in a scanning direction at the time when a liquid ejection head is moved to one side of the scanning direction and when the liquid ejection head is moved to the other side is suppressed in bidirectional printing.

SUMMARY

According to one aspect, this specification discloses a printer. The printer includes a liquid ejection head, a heat generator, a temperature sensor, and a controller. The liquid ejection head has a plurality of nozzles and has a plurality of drive elements configured to cause the plurality of nozzles to eject liquid. The temperature sensor is configured to detect a temperature of the liquid ejection head. The heat generator generates heat when the plurality of drive elements is driven. The controller is configured to: perform a determining process of determining, based on a particular parameter indicative of a temperature difference, whether the printer is in a first state where the temperature difference is constant or in a second state where the temperature difference varies with time, the temperature difference being a temperature difference between the temperature detected by the temperature sensor and an actual temperature of the liquid ejection head; and control the plurality of drive elements based on a determination result in the determining process.

BRIEF DESCRIPTION OF THE DRAWINGS

Embodiments in accordance with this disclosure will be described in detail with reference to the following figures wherein.

DETAILED DESCRIPTION

The inventors of this disclosure found that, when the liquid ejection head is driven, after the temperature of the liquid ejection head is increased enough, a temperature difference between the temperature detected by the temperature sensor and the actual temperature of the liquid ejection head is substantially constant (a first state), and before that, a period in which the temperature difference between the temperature detected by the temperature sensor and the actual temperature of the liquid ejection head is not constant (a second state) exists. In the above-mentioned inkjet printer, if the ejection timing is determined as described above in the second state, the ejection timing may not be determined appropriately.

Other than the above-described ejection timing, if controls are performed by assuming that the temperature difference between the temperature detected by the temperature sensor and the actual temperature of the liquid ejection head is constant when it is not, some problem may occur.

An example of an object of this disclosure is to provide a printer that performs controls by considering whether a temperature difference between the temperature detected by a temperature sensor and the actual temperature of a liquid ejection head is constant.

An aspect of this disclosure will be described while referring to the accompanying drawings.

<Overall Configuration of Printer>

Figure 1:
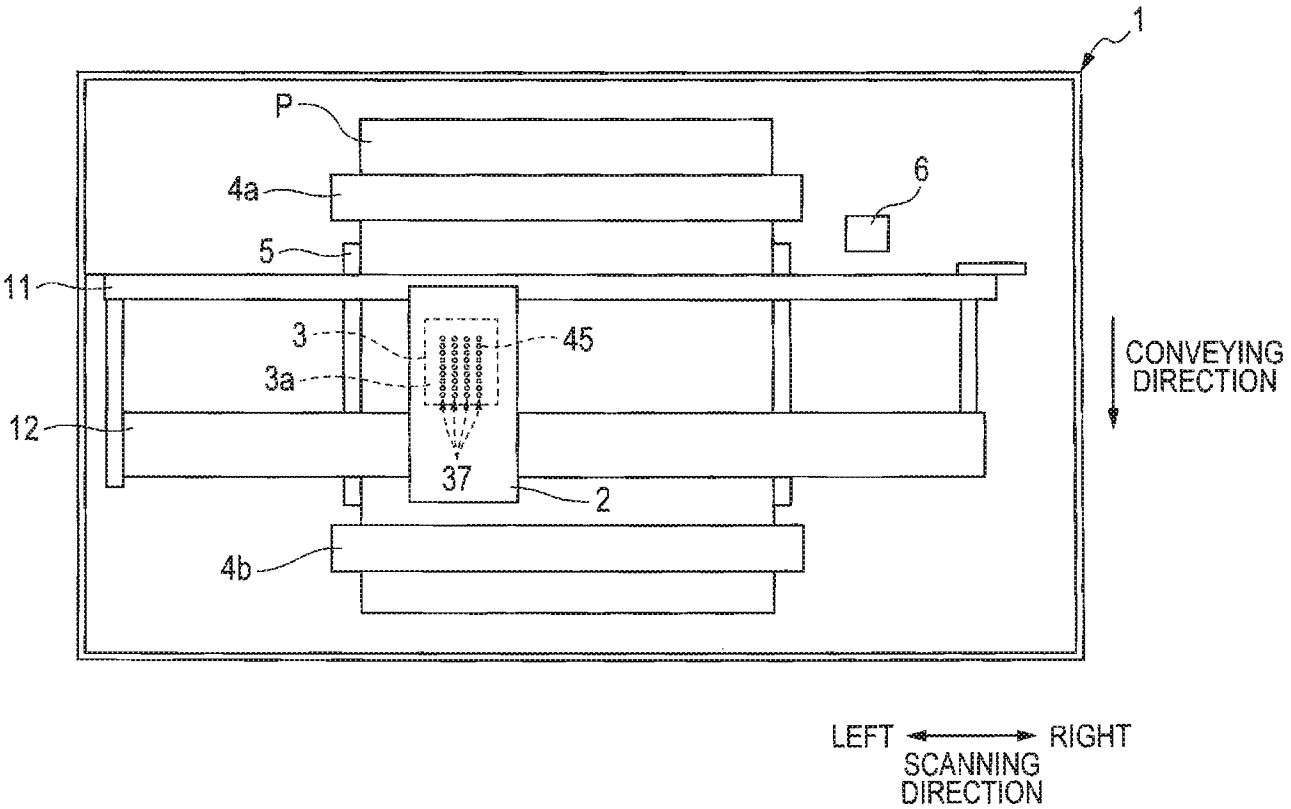
FIG. 1 is a schematic diagram of a printer according to an embodiment of this disclosure.

As shown in FIG. 1, a printer 1 (an example of a printer) according to the embodiment includes a carriage 2, an inkjet head 3 (an example of a liquid ejection head), conveying rollers 4*a*, 4*b*, a platen 5, a surrounding temperature sensor 6 (an example of a second temperature sensor), and so on.

The carriage 2 is supported by two guide rails 11, 12 extending in a scanning direction, movably in the scanning direction. The carriage 2 is connected to a carriage motor 76 (see FIG. 4) via a belt (not shown) or the like and moves in the scanning direction when the carriage motor 76 is driven. In the embodiment, combination of the carriage 2 and the carriage motor 76 and so on for moving the carriage 2 in the scanning direction serves as a head moving device. Hereinafter, descriptions will be made by defining a right side and a left side of the scanning direction as shown in FIG. 1.

The inkjet head 3 is mounted on the carriage 2 and ejects ink from a plurality of nozzles 45 formed on a nozzle surface 3*a* that is a lower surface of the carriage 2. The conveying roller 4*a* is located at an upstream side of the inkjet head 3 in a conveying direction perpendicular to the scanning direction. The conveying roller 4*b* is located at a downstream side of the inkjet head 3 in the conveying direction. The conveying rollers 4*a*, 4*b* are connected to a conveying motor 77 (see FIG. 4) via a gear and so on (not shown). When the conveying motor 77 is driven, the conveying rollers 4*a*, 4*b* rotate to convey a recording sheet P in the conveying direction. In the embodiment, combination of the conveying rollers 4*a*, 4*b* and the conveying motor 77 and so on for rotating the conveying rollers 4*a*, 4*b* serves as a conveying device.

The platen 5 is located between the conveying roller 4*a* and the conveying roller 4*b* in the conveying direction. The platen 5 is located at a lower side of the inkjet head 3 and faces the nozzle surface 3*a*. The platen 5 supports, from downward, a part of a recording sheet P facing the nozzle surface 3*a*, the recording sheet P being conveyed by the conveying rollers 4*a*, 4*b*. The surrounding temperature sensor 6 is provided in a part of the printer 1 near the inkjet head 3, and detects a surrounding temperature of the inkjet head 3. The surrounding temperature of the inkjet head 3 is, for example, an air temperature near the inkjet head 3. Specifically, the surrounding temperature sensor 6 is arranged, for example, on a circuit board provided in a main casing of the printer 1, such as on a circuit board for detecting a residual amount of ink in an ink cartridge (not shown) that is provided in a cartridge accommodating part in which the ink cartridge is accommodated. As shown in FIG. 1, the surrounding temperature sensor 6 and the inkjet head 3 have a space (interval) therebetween.

<Inkjet Head>

Figure 2:
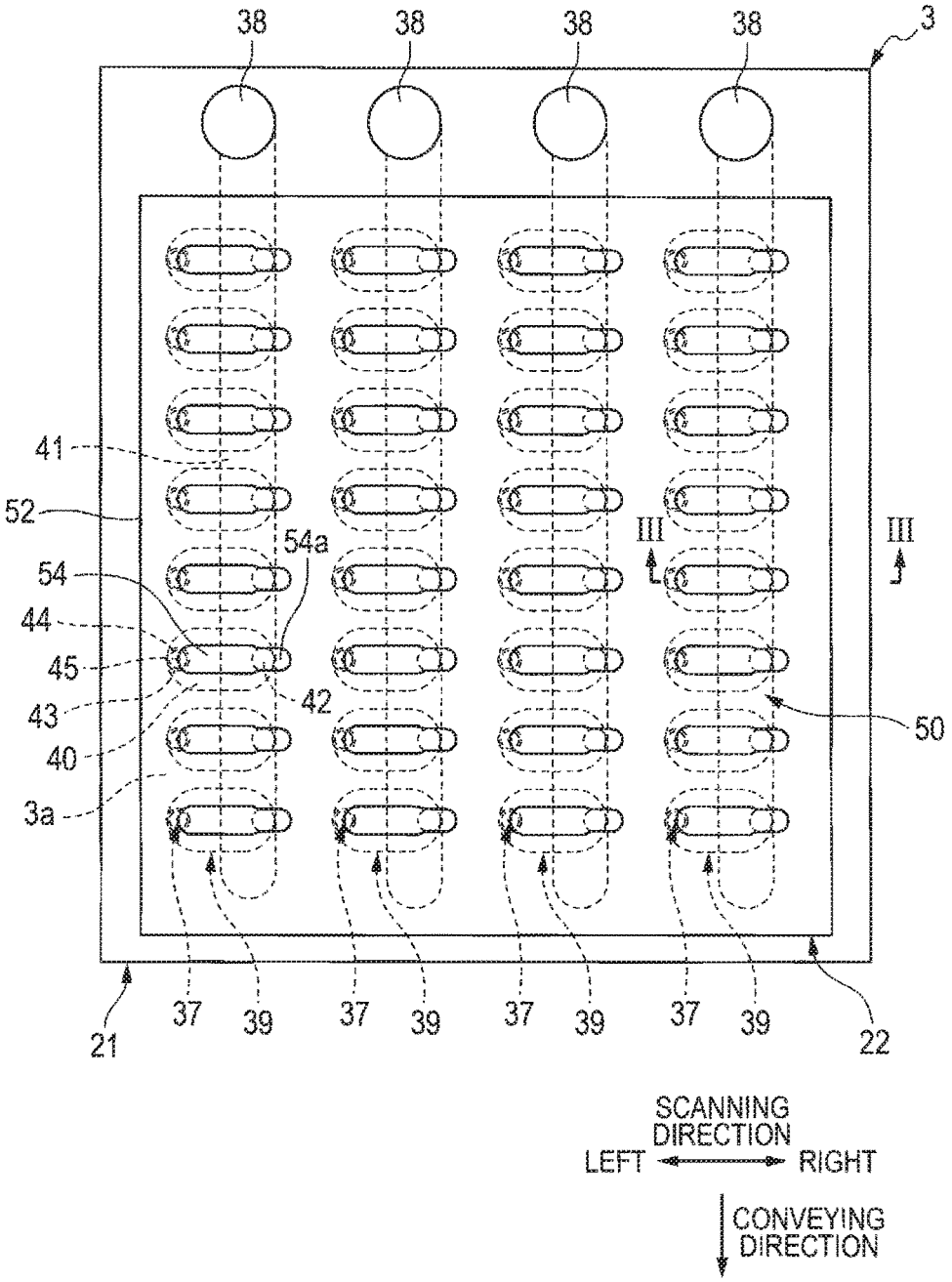
FIG. 2 is a plan view of an inkjet head.
Figure 3:
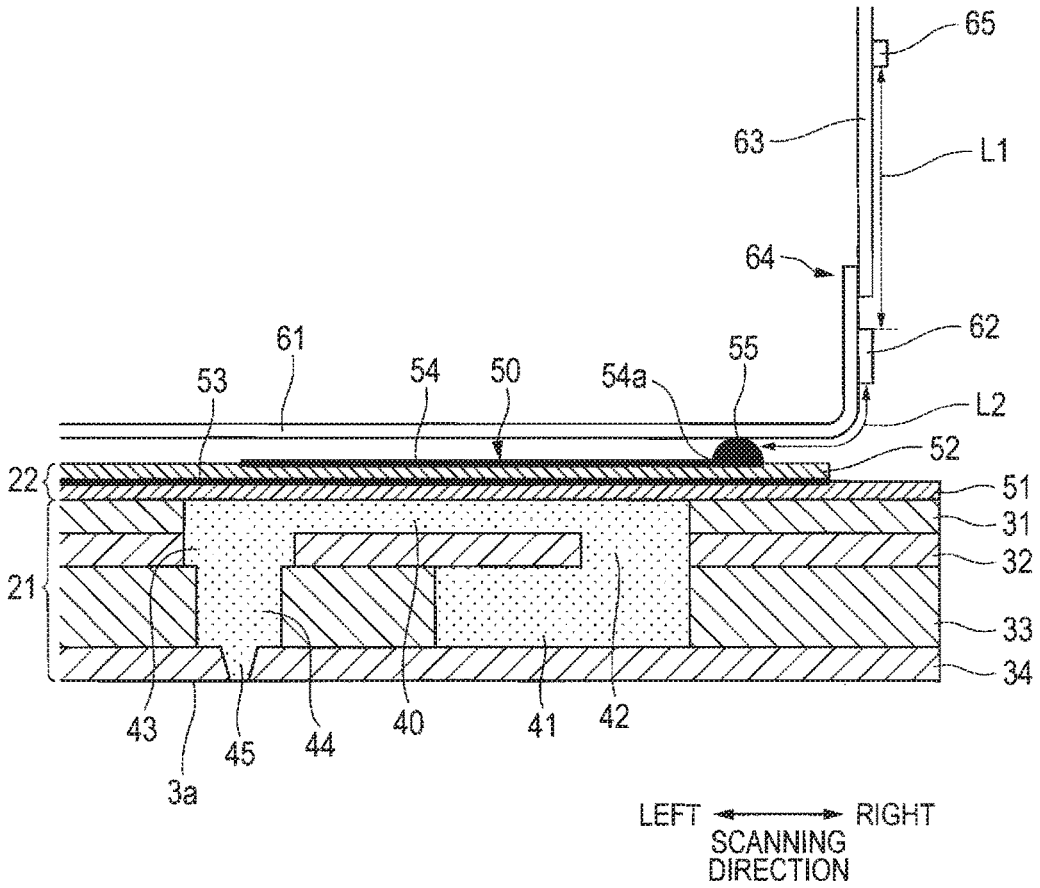
FIG. 3 is a cross-sectional view taken along a line of FIG. 2.

Next, a structure of the inkjet head 3 will be described. As shown in FIG. 2 and FIG. 3, the inkjet head 3 has a channel unit 21 and a piezoelectric actuator 22.

<Channel Unit>

The channel unit 21 is formed of four plates 31 to 34 that are laminated vertically. Among the four plates 31 to 34, the upper three plates 31 to 33 are formed of a metal material such as stainless steel and the lowest plate 34 is formed of a synthetic resin material such as polyimide.

In the plate 31, a plurality of pressure chambers 40 are formed. The pressure chambers 40 have a substantially elliptical shape elongated in the scanning direction in a plan view. The plurality of pressure chambers 40 form pressure chamber arrays 39 by being arranged in the conveying direction. In the plate 31, four pressure chamber arrays 39 arranged in the scanning direction are formed.

In the plate 32, a plurality of through holes 42 having a substantially circular shape is formed in a part overlapping a right end portion of the plurality of pressure chambers 40. In the plate 32, a plurality of through holes 43 having a substantially circular shape is formed in a part overlapping a left end portion of the plurality of pressure chambers 40.

In the plate 33, four manifold channels 41 are formed. The four manifold channels 41 correspond to the four pressure chamber arrays 39. Each manifold channel 41 extends in the conveying direction across the plurality of pressure chambers 40 forming the corresponding pressure chamber array 39, and overlaps a substantially right half of these pressure chambers 40. Ink is supplied to each manifold channel 41 through an ink supply port 38 formed in an upstream end portion in the conveying direction. In the plate 33, a plurality of through holes 44 having a substantially circular shape is formed in a part overlapping the plurality of through holes 43.

In the plate 34, a plurality of nozzles 45 is formed in a part overlapping the plurality of through holes 44. The plurality of nozzles 45 is opened in a lower surface of the plate 34 that is the nozzle surface 3*a*. The plurality of nozzles 45 forms nozzle arrays 37 by being arranged in the conveying direction similarly to the plurality of pressure chambers 40. In the plate 34, four nozzle arrays 37 arranged in the scanning direction are formed. Ink of black, yellow, cyan, and magenta is ejected from the plurality of nozzles 45 in this order from the nozzle array 37 at the right end.

<Piezoelectric Actuator>

The piezoelectric actuator 22 has a vibration plate 51, a piezoelectric layer 52, a common electrode 53, and a plurality of individual electrodes 54. The vibration plate 51 is formed of a piezoelectric material having lead zirconate titanate that is a mixed crystal of lead titanate and lead zirconate, as a main component. The vibration plate 51 is arranged on an upper surface of the channel unit 21 (upper surface of the plate 31). However, the vibration plate 51 may be formed of an insulating material other than the piezoelectric layer, such as a synthetic resin material, unlike the piezoelectric layer 52 described below.

The piezoelectric layer 52 is formed of a piezoelectric material and extends continuously across the plurality of pressure chambers 40 on an upper surface of the vibration plate 51. The common electrode 53 extends continuously across the plurality of pressure chambers 40 between the vibration plate 51 and the piezoelectric layer 52. The common electrode 53 is always kept at a ground potential.

The plurality of individual electrodes 54 is individually provided for the plurality of pressure chambers 40. Each individual electrode 54 has a substantially elliptical shape that is smaller than the pressure chambers 40 in a plan view. Each individual electrode 54 is arranged on the top surface of the piezoelectric layer 52 so as to overlap a center part of the corresponding pressure chamber 40. A right end portion of each individual electrode 54 extends to a right side up to a position not overlapping the pressure chamber 40 and its tip end portion is a connection terminal 54*a*. Bumps 55 formed of a conductive material and protruding upward are arranged on an upper surface of the connection terminal 54*a*. One of a ground potential and a particular driving potential V is selectively applied individually to the plurality of individual electrodes 54, by a driver IC 62 described later.

In the piezoelectric actuator 22 having the above-described configuration, the common electrode 53 and the plurality of individual electrodes 54 are arranged in this way. In connection to this arrangement, a part sandwiched by each individual electrode 54 of the piezoelectric layer 52 and the common electrode 53 are polarized in a thickness direction. Each part overlapping each pressure chamber 40 of the piezoelectric actuator 22 serves as a drive element 50 for ejecting ink from the corresponding nozzle 45.

A method for driving the piezoelectric actuator 22 (the plurality of drive elements 50) to eject ink from the nozzles 45 will be described. In the piezoelectric actuator 22, all individual electrodes 54 are kept at the ground potential preliminarily by the driver IC 62. In order to eject ink from a certain nozzle 45, the potential of the individual electrode 54 that corresponds to the nozzles 45 is switched from the ground potential to the driving potential by the driver IC 62. Then, due to the potential difference between the individual electrode 54 and the common electrode 53, an electric field in a polarization direction is generated in a part of the piezoelectric layer 52 sandwiched by these electrodes, and the part of the piezoelectric layer 52 is contracted in a surface direction perpendicular to the polarizing direction. Thereby, a part of the vibration plate 51 and the piezoelectric layer 52 overlapping the pressure chamber 40 is deformed to be convex toward the pressure chamber 40 as a whole. As a result, the volume of the pressure chamber 40 decreases, and thereby the pressure of ink in the pressure chamber 40 is increased and ink is ejected from the nozzle 45 communicating with the pressure chamber 40.

<COF>

A COF (chip on film) 61 is arranged above the piezoelectric actuator 22. The COF 61 is connected to the plurality of bumps 55. The COF 61 extends to the right side from connection with the plurality of bumps 55 and is bent upward. The driver IC 62 (an example of a heat generator) is mounted on a part of the COF 61 extending vertically. The driver IC 62 is connected to the plurality of individual electrodes 54 via a wiring (not shown) that is formed in the COF 61 and via the bumps 55.

<FPC>

A FPC (flexible printed circuit) 63 is connected to an upper end portion of the COF 61. The FPC 63 extends upward from connection with the COF 61. An end portion of the FPC 63 opposite the COF 61 is connected to a board (not shown) that is connected to a controller 70. A thermistor 65 (an example of a temperature sensor and a first temperature sensor) is arranged at a middle portion of the FPC 63. The thermistor 65 is for detecting temperature of the inkjet head 3.

The inkjet head 3, the driver IC 62, and the thermistor 65 are connected to each other by a wiring member 64 (an example of a connecting member) that includes the COF 61 and the FPC 63. The inkjet head 3, the driver IC 62, and the thermistor 65 are arranged as described above. Thus, in a direction in which the wiring member 64 extends, the thermistor 65 is located at the opposite side from the inkjet head 3 with respect to the driver IC 62. As shown in FIG. 3, a length L1 of the wiring member 64 from connection with the thermistor 65 to connection with the driver IC 62 is longer than a length L2 of the wiring member 64 from connection with the inkjet head 3 to connection with the driver IC 62.

<Controller>

Figure 4:
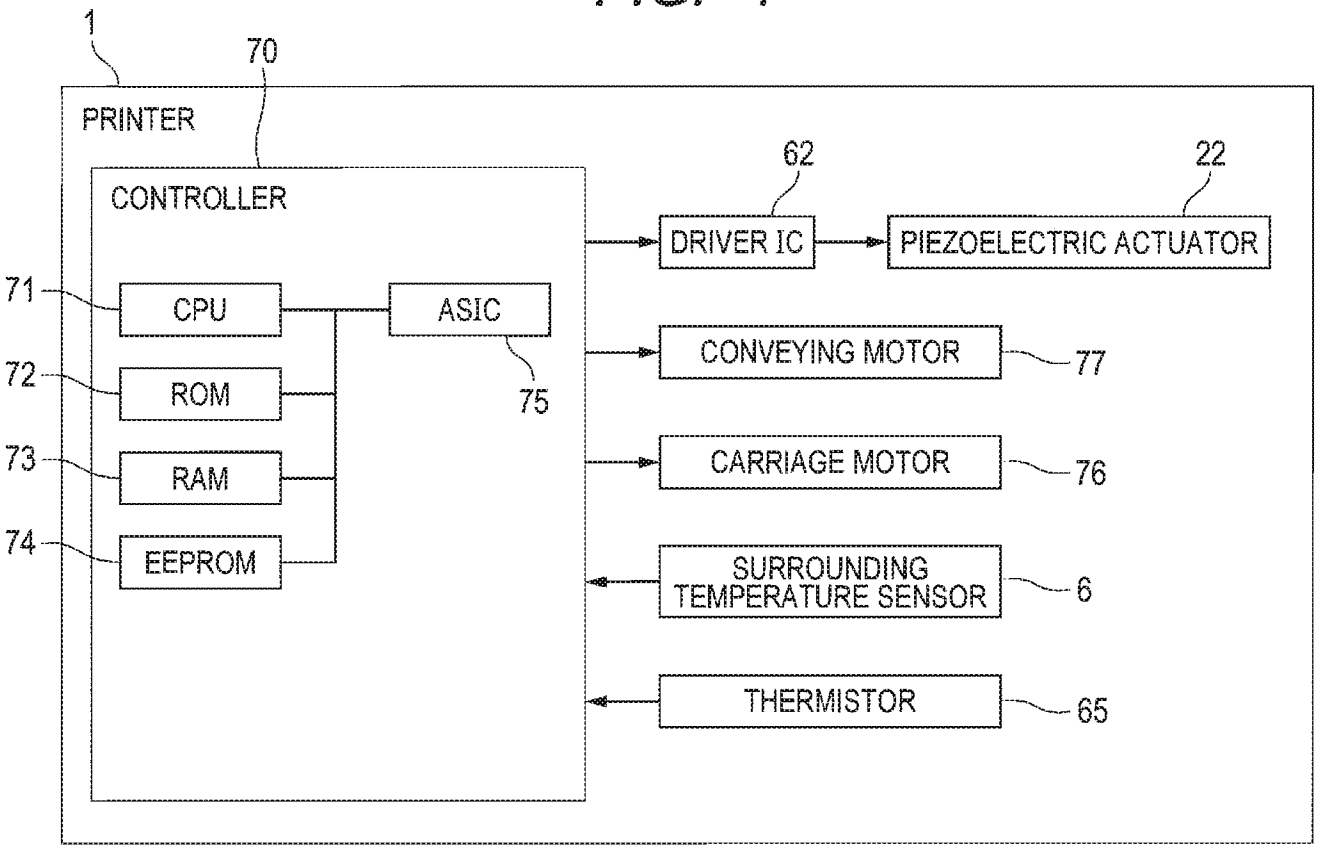
FIG. 4 is a block diagram showing an electrical configuration of the printer.

The controller 70 controls operations of the printer 1. As shown in FIG. 4, the controller 70 includes a CPU (central processing unit) 71, a ROM (read only memory) 72, a RAM (random access memory) 73, an EEPROM (electrically erasable programmable read only memory) 74, an ASIC (application specific integrated circuit) 75, and so on, and these control the carriage motor 76, the driver IC 62, the conveying motor 77, and so on. Signals are inputted to the controller 70 from the surrounding temperature sensor 6, the thermistor 65, and so on.

FIG. 4 shows only one CPU 71. The controller 70 may include only one CPU 71 and the one CPU 71 may perform processes collectively. The controller 70 may include a plurality of CPUs 71 and the plurality of CPUs 71 may perform processes by sharing. FIG. 4 shows only one ASIC 75. The controller 70 includes only one ASIC 75 and the one ASIC 75 may perform processes collectively. The controller 70 may include a plurality of ASICs 75 and the plurality of ASICs 75 may perform processes by sharing.

<Operation of Printer at the Time of Printing>

Next, operation of the printer at the time of printing will be described. The printer 1 performs printing on the recording sheet P by alternately repeating scan printing and conveying of the recording sheet P. In the scan printing, while the carriage 2 is moved in the scanning direction, ink is ejected from the plurality of nozzles 45 of the inkjet head 3. In the conveying of the recording sheet P, the recording sheet P is conveyed in the conveying direction by the conveying rollers 4*a*, 4*b*. The printer 1 can selectively perform one of bidirectional printing and unidirectional printing. In the bidirectional printing, the plurality of nozzles 45 ejects ink in both when the carriage 2 is moved to the right side and when the carriage 2 is moved to the left side. In the unidirectional printing, the plurality of nozzles 45 ejects ink only when the carriage 2 is moved to the right side or the left side.

<Process at the Time of Printing>

Next, a flow of controls of the controller 70 at the time of printing by the printer 1 will be described.

Figure 5:
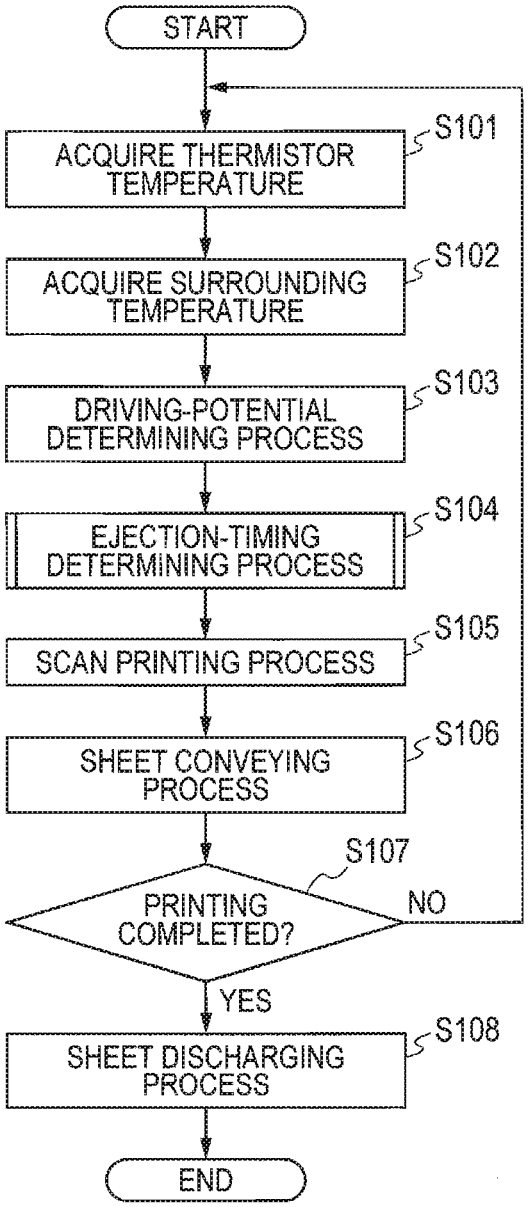
FIG. 5 is a flowchart showing a flow of processes in printing.

As shown in FIG. 5, when printing is performed by the printer 1, the controller 70 first acquires the temperature detected by the thermistor 65 (hereinafter, referred to as "thermistor temperature Ts") (S101). Subsequently, the controller 70 acquires the temperature detected by the surrounding temperature sensor 6 (hereinafter, referred to as "surrounding temperature Te") (S102). Any of S101 and S102 may be performed first, or S101 and S102 may be performed concurrently.

Next, the controller 70 performs a driving-potential determining process (S103) for determining the driving potential V of the drive element 50 in scan printing based on the thermistor temperature Ts. Subsequently, the controller 70 performs an ejection-timing determining process for determining ejection timing of ink from the plurality of nozzles in scan printing based on the thermistor temperature Ts and the surrounding temperature Te (S104). Any of S103 and S104 may be performed first, or S103 and S104 may be performed concurrently. The driving-potential determining process and the ejection-timing determining process will be described later in detail.

Next, the controller 70 performs a scan printing process for performing scan printing (S105). In the scan printing process, while the controller 70 controls the carriage motor 76 to move the carriage 2 in the scanning direction, the controller 70 controls the plurality of drive elements 50 through the driver IC 62 to eject ink from the plurality of nozzles 45 to perform scan printing. At this time, the plurality of drive elements 50 is driven by applying the driving potential V determined in S103 to the individual electrodes 54. Ink is ejected from the nozzles 45 by driving the drive elements 50 at the ejection timing determined in S104.

Next, the controller 70 controls the conveying motor 77 to perform a sheet conveying process for controlling the conveying rollers 4*a*, 4*b* to convey the recording sheet P by a particular distance (S106). When printing is not completed (S107: No), the process returns to S101. When printing is completed, the controller 70 controls the conveying motor 77 such that the conveying rollers 4*a*, 4*b* convey the recording sheet P, thereby performing a sheet discharging process for discharging the recording sheet P (S108), and ends the process.

<Driving-Potential Determining Process>

Next, the driving-potential determining process of S103 will be described. The EEPROM 74 stores a table in which the thermistor temperature Ts and the driving potential V are associated with each other. In S103, the driving potential V is determined based on this table and the thermistor temperature Ts.

The lower the temperature of the inkjet head 3 is, the higher the viscosity of ink in the inkjet head 3 is. Therefore, in order to eject ink from the nozzles 45 at a certain ejection speed, higher pressure (larger ejection energy) needs to be applied to ink in the nozzles 45 when the temperature of the inkjet head 3 is lower. On the other hand, the higher the driving potential V is, the higher the pressure applied to ink in the nozzles 45 is. Thus, in the table described above, the lower the thermistor temperature Ts is, the higher the driving potential V is. Note that, based on the above, determining the driving potential V is the same as determining the ejection speed of ejecting ink from the nozzles 45.

<Ejection-Timing Determining Process>

Figure 6:
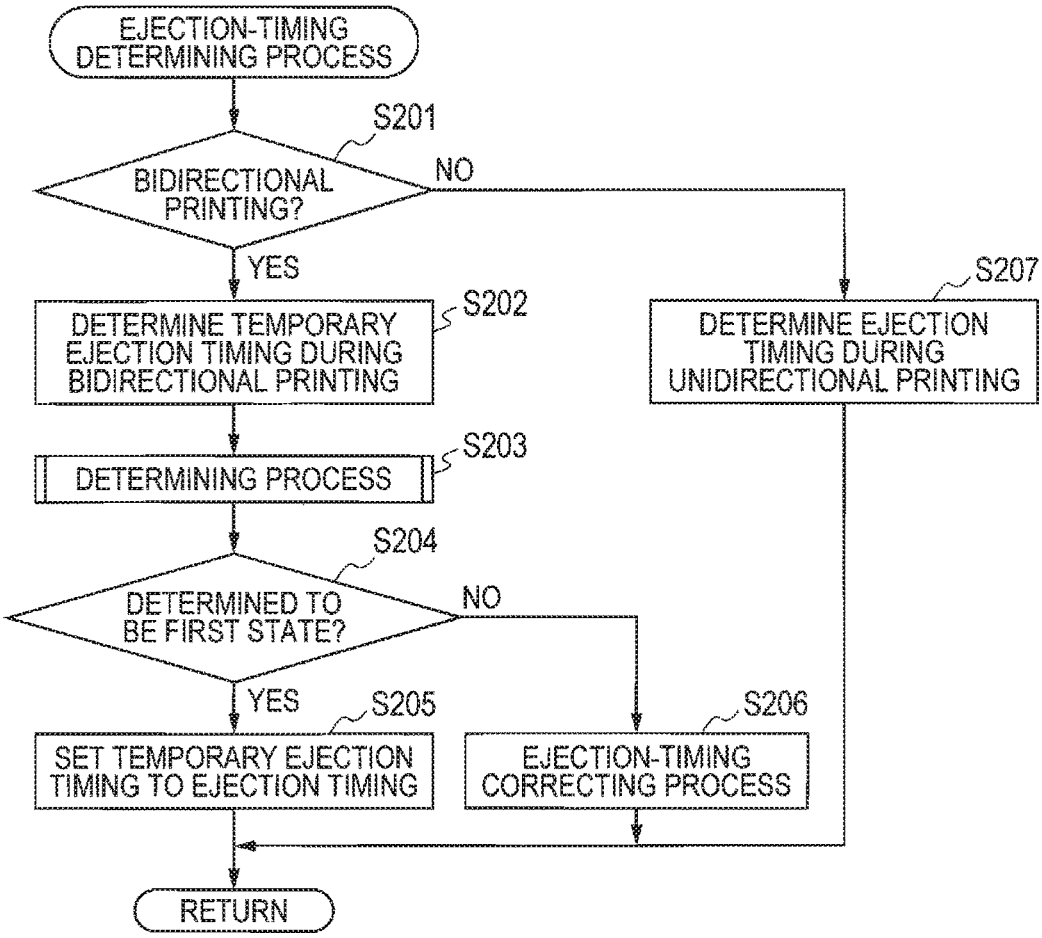
FIG. 6 is a flowchart showing a flow of an ejection-timing determining process of FIG. 5.

Next, the ejection-timing determining process of S104 will be described. As shown in FIG. 6, in the ejection-timing determining process, the controller 70 determines whether bidirectional printing is performed or unidirectional printing is performed based on printing data inputted to the printer 1 (S201).

When bidirectional printing is performed (S201: Yes), the controller 70 subsequently determines tentative ejection timing in bidirectional printing (S202). In S202, for example, the controller 70 reads out, from the EEPROM 74, information on the ejection timing in the bidirectional printing that is stored preliminarily, and determines the temporary ejection timing based on the read information. The temporary ejection timing is such timing that, in a first state described later, no positional deviation in the scanning direction is generated at the joint between: an image G1 (see FIG. 8A) printed by scan printing in which the carriage 2 is moved to the right side; and an image G2 (see FIG. 8B) printed by scan printing in which the carriage 2 is moved to the left side.

Subsequently, the controller 70 performs a determining process for determining whether it is in a first state where a temperature difference ΔT1 between the thermistor temperature Ts and the actual temperature of the inkjet head 3 (hereinafter, referred to as "head temperature Th") is constant or in a second state where the temperature difference ΔT1 varies with time (S203). In the embodiment, the meaning of the phrase "the temperature difference ΔT1 is constant" includes not only that the temperature difference ΔT1 is strictly constant, but also that, although the temperature difference ΔT1 varies slightly with time (for example, varies about ±1 degree Celsius), it can be considered that the temperature difference ΔT1 is constant. In the embodiment, the actual temperature of the inkjet head 3 is, for example, a temperature of a center part of the nozzle surface 3*a*.

Figure 7:
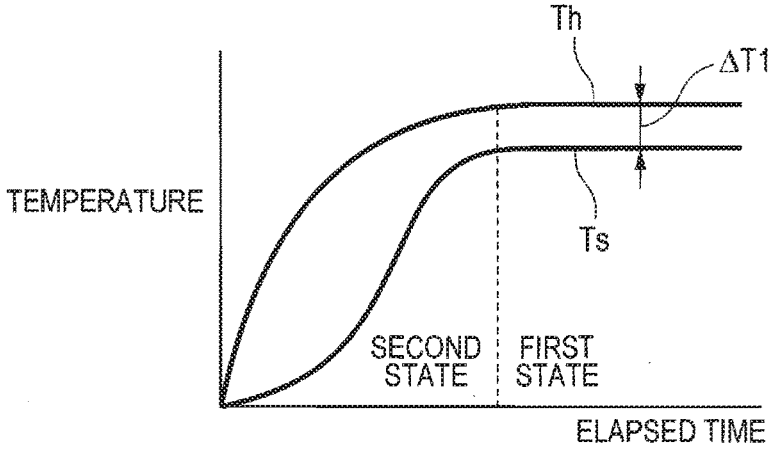
FIG. 7 is a diagram showing a relationship between elapsed time from start of driving of drive elements, and a temperature detected by a thermistor and an actual temperature of the inkjet head.

When the drive elements 50 are driven by the driver IC 62, the driver IC 62 generates heat, heat of the driver IC 62 is transmitted to the inkjet head 3 and the thermistor 65 via the wiring member 64, and the thermistor temperature Ts and the head temperature Th increase. As shown in FIG. 7, if driving of the drive elements 50 continues, the temperature difference ΔT1 between the thermistor temperature Ts and the head temperature Th becomes constant eventually (the first state).

In the embodiment, since the thermistor 65 is located at the opposite side from the inkjet head 3 with respect to the driver IC 62, the ways in which heat is transmitted from the driver IC 62 to the inkjet head 3 and to the thermistor 65 are different. The length L1 of the portion of the wiring member 64 from the thermistor 65 to the driver IC 62 is longer than the length L2 of the portion from the inkjet head 3 to the driver IC 62. Thus, transmission of heat from the driver IC 62 to the thermistor 65 takes longer time than transmission from the driver IC 62 to the inkjet head 3.

From these, as shown in FIG. 7, there is a period in which the temperature difference ΔT1 varies with time (the second state) from start of driving of the plurality of drive elements 50 by the driver IC 62 until becoming the first state. In S203, the controller 70 determines whether it is in the first state or in the second state. The method of determination in the determining process will be described later.

When it is determined that it is in the first state in S203 (S204: Yes), the controller 70 sets the temporary ejection timing determined in S202 to the ejection timing in bidirectional printing as it is (S205). That is, when it is determined that it is in the first state in S203, the temporary ejection timing is not corrected.

On the other hand, when it is determined that it is in the second state in S203 (S204: No), the controller 70 subsequently performs the ejection-timing correcting process (an example of a correcting process) for correcting the temporary ejection timing. Thereby, it is determined that the corrected ejection timing is the ejection timing in the bidirectional printing.

Figure 8A:
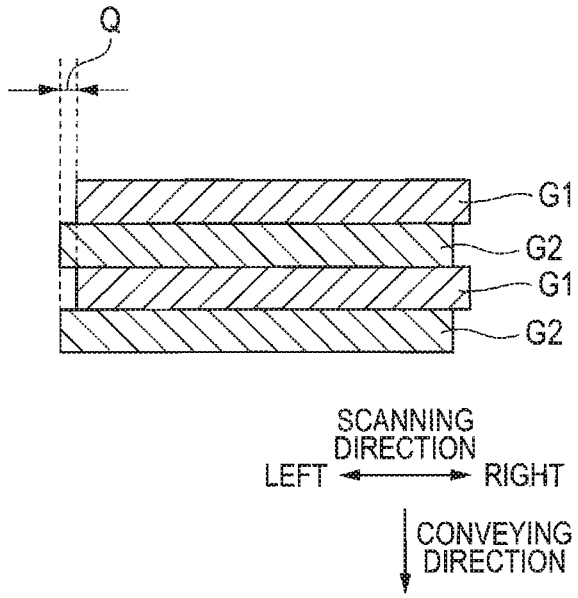
FIG. 8A is a diagram for illustrating deviation between images printed by scan printing when bidirectional printing is performed by ejecting ink at temporary ejection timing in a second state.

Assume that the driving potential V is determined based on the thermistor temperature Ts in the second state. In this case, if the plurality of drive elements 50 are driven by the determined driving potential V in scan printing, the ejection speed of ink ejected from the nozzles 45 is different from the ejection speed in a case where the driving potential V is determined based on the thermistor temperature Ts in the first state. Therefore, droplet landing positions of ink ejected from the nozzles 45 in scan printing are deviated in the scanning direction. At this time, the droplet landing positions of ink are deviated in the opposite directions in scan printing in which the carriage 2 is moved to the right side and in scan printing in which the carriage 2 is moved to the left side. As a result, for example, as shown in FIG. 8A, deviation in the scanning direction is generated at the joint between the image G1 printed by scan printing in which the carriage 2 is moved to the right side and the image G2 printed by scan printing in which the carriage 2 is moved to the left side.

Accordingly, when bidirectional printing is performed, in the second state, the temporary ejection timing is corrected in order to prevent the deviation. The way to correct the ejection timing will be described later in detail.

On the other hand, when unidirectional printing is performed (S201: No), the controller 70 determines the ejection timing in unidirectional printing (S207). In S207, the controller 70 reads out, from the EEPROM 74, information on the ejection timing in unidirectional printing that is stored preliminarily, and determines the ejection timing in unidirectional printing based on the information. That is, when unidirectional printing is performed, unlike bidirectional printing, correction of the ejection timing corresponding to S206 is not performed even in the second state.

<Determining Process>

Next, a determining process of S203 will be described.

An amount of deviation Q in the scanning direction at the joint between the image G1 and the image G2 shown in FIG.

Figure 8B:
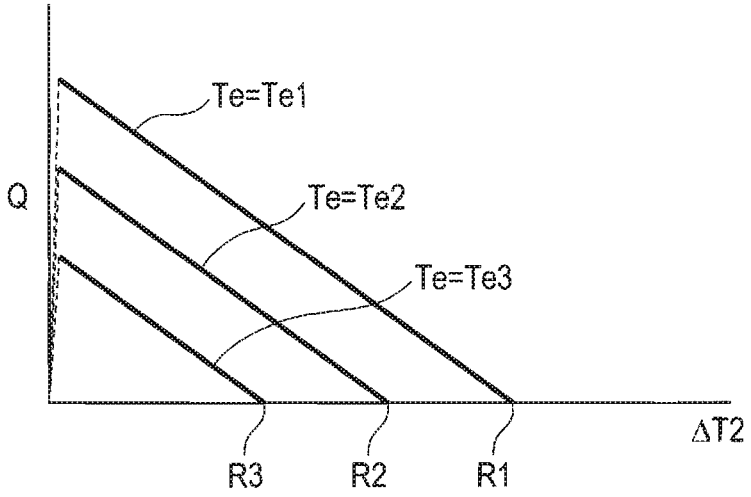
FIG. 8B is a diagram showing a relationship among an amount of deviation between the above images, a temperature difference between a thermistor temperature and a surrounding temperature of the inkjet head, and the surrounding temperature.

8A has a relationship relative to a temperature difference ΔT2 between the thermistor temperature Ts and the surrounding temperature Te, for each of the surrounding temperatures Te, as shown in FIG. 8B. The surrounding temperatures Te1 to Te3 of FIG. 8B have a relationship of Te1<Te2<Te3. From the relationship of FIG. 8B, it is recognized that when the temperature difference ΔT2 is smaller than threshold values R (R1, R2, R3) for each surrounding temperature Te, the smaller the temperature difference ΔT2 is, the larger the deviation in the scanning direction is at the joint. It is also recognized that, when the temperature difference ΔT2 is equal to or larger than the threshold value R for each surrounding temperature Te, no deviation in the scanning direction is generated at the joint. That is, it is recognized that it is in the first state when the temperature difference ΔT2 is equal to or larger than the threshold value R, and it is in the second state when the temperature difference ΔT2 is smaller than the threshold value R. It is recognized from FIG. 8B that the higher the surrounding temperature Te is, the lower the threshold value R is (R1>R2>R3).

As described above, when the plurality of drive elements 50 are driven, it becomes the first state after the second state. Thus, it is predictable that there is tendency that the amount of deviation Q is the largest at the time of starting driving of the plurality of drive elements 50 and that, as time elapses, the amount of deviation Q decreases.

In the embodiment, ink flows into the manifold channels 41 from the ink supply port 38 and ink flowing into the manifold channels 41 flows in the manifold channels 41 from the upstream side to the downstream side in the conveying direction. At this time, the inkjet head 3 is cooled by ink near the ink supply port 38 of the manifold channels 41 in an upstream end portion in the conveying direction. On the other hand, ink in the manifold channel 41 is heated by the inkjet head 3 during flowing from the upstream side to the downstream side in the conveying direction. Therefore, a downstream end portion of the inkjet head 3 in the conveying direction is hard to be cooled by ink in the manifold channels 41. Thus, the head temperature of the downstream end portion of the inkjet head 3 in the conveying direction is higher than the head temperature of the upstream end portion.

At this time, the lower the surrounding temperature Te is, the lower the temperature of ink supplied from the ink supply port 38 to the manifold channels 41 is. Thus, a temperature gradient between the upstream part of the inkjet head 3 and the downstream part of the inkjet head 3 in the conveying direction is large. In this case, the temperature difference between ink in the nozzle 45 at the upstream side in the conveying direction and ink in the nozzle 45 at the downstream side is large. And, deviation of droplet landing positions between ink ejected from the nozzles 45 at the upstream side and ink ejected from the nozzles 45 at the downstream side becomes large. Thus, it is assumed that the amount of deviation Q becomes large.

Further, the lower the surrounding temperature Te is, the larger the heat quantity absorbed by the inkjet head 3 is. Therefore, a period from start of driving of the plurality of drive elements 50 until the temperature of the inkjet head 3 is increased enough to become the first state becomes longer. If this time is long, the thermistor temperature Ts becomes high before the temperature of the inkjet head 3 is increased enough. Therefore, the temperature difference ΔT2 between the thermistor temperature Ts and the surrounding temperature Te becomes larger. Thus, the lower the surrounding temperature Te is, the larger the temperature difference ΔT2 at the time of switching from the second state to the first state is.

Taking these qualitative tendencies into consideration, a relationship similar to FIG. 8B can be obtained. Thus, it is expected that the relationship shown in FIG. 8B has reproducibility in a range where the qualitative tendencies are maintained.

Figures 9, 10:
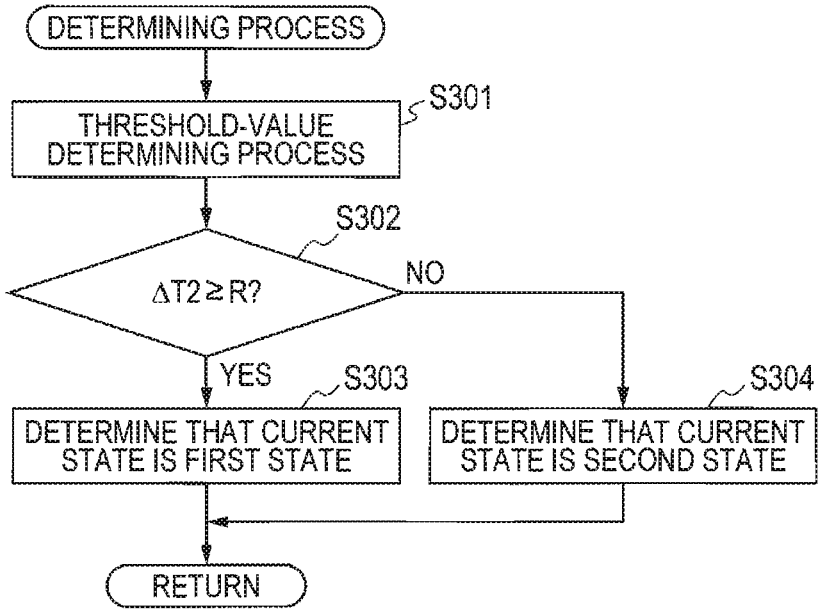
FIG. 9 is a flowchart showing a flow of a determining process of FIG. 6.
FIG. 10 is a diagram showing a table that stores correction amounts in relation to a temperature difference between the thermistor temperature and the surrounding temperature and in relation to the surrounding temperature.

Thus, in the determining process of S203, the controller 70 determines whether it is in the first state or in the second state, as follows. That is, as shown in FIG. 9, the controller 70 first performs a threshold-value determining process for determining the threshold value R based on the surrounding temperature Te (S301). In S301, the threshold value R is determined to be smaller when the surrounding temperature Te is higher. Subsequently, when the temperature difference ΔT2 is equal to or larger than the threshold value R (S302: Yes), the controller 70 determines that it is in the first state, and when the temperature difference ΔT2 is smaller than the threshold value R (S302: No), the controller 70 determines that it is in the second state (S304).

<Ejection-Timing Correcting Process>

Next, an ejection-timing correcting process of S206 will be described.

As shown in FIG. 10, the EEPROM 74 (an example of a memory) preliminarily stores a table (an example of correction information) in which amounts of correction U of the ejection timing are associated with the temperature differences ΔT2 and the surrounding temperatures Te. In this table, when the surrounding temperature Te is same, the smaller the temperature difference ΔT2 is, the larger the amount of correction U is (U11>U21>U31, U12>U22>U32, U13>U23>U33). When the temperature difference ΔT2 is same, the lower the surrounding temperature Te is, the larger the amount of correction U is (U11>U12>U13, U21>U22>U23, U21>U22>U23). This relationship corresponds to the relationship of FIG. 8B. That is, as the amount of deviation Q is larger when ink is ejected at the temporary ejection timing, the amount of correction U is larger.

In S206, the controller 70 determines the amount of correction U based on the table in FIG. 10, the temperature difference ΔT2, and the surrounding temperature Te. Thereby, ink is ejected from the nozzles 45 at the ejection timing obtained by correcting the temporary ejection timing by the amount of correction U. Then, the deviation in the scanning direction of the joint between the image G1 and the image G2 can be suppressed appropriately.

As described above, it can be expected that the relationship of FIG. 8B has reproducibility. Thus, as described above, the table in FIG. 10 is stored preliminarily in the EEPROM 74, the amount of correction U is determined by using the table, and ink is ejected at a timing deviated from the temporary ejection timing by the amount of correction U. Then, deviation in the scanning direction of the joint between the image G1 and the image G2 can be suppressed appropriately.

While the disclosure has been described in detail with reference to the above aspects thereof, it would be apparent to those skilled in the art that various changes and modifications may be made therein without departing from the scope of the claims.

In the above-described embodiment, the temporary ejection timing in bidirectional printing is determined and when it is in the second state, the temporary ejection timing is corrected. However, the correction is not limited to this.

Figure 11:
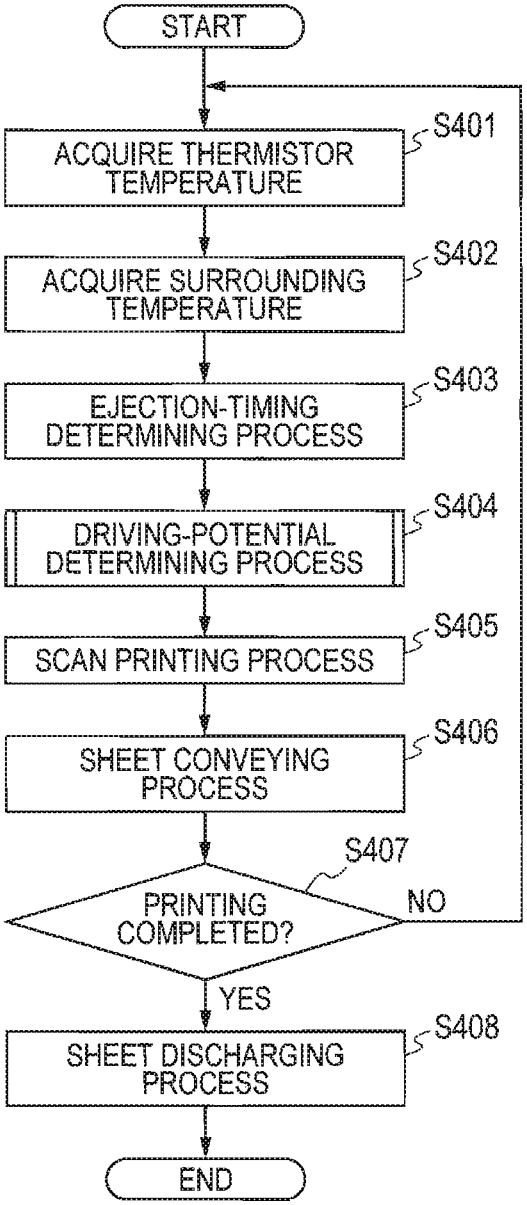
FIG. 11 is a flowchart showing a flow of processes in printing according to a first modification.

As shown in FIG. 11, in a first modification, the controller 70 acquires the thermistor temperature Ts (S401) and acquires the surrounding temperature Te (S402) in a similar manner to S101 and S102 of the above-described embodiment. Subsequently, the controller 70 determines the ejection timing in bidirectional printing (S403). In S403, regardless of whether it is in the first state or in the second state, the ejection timing in bidirectional printing is determined based on information on the ejection timing in bidirectional printing read out from the EEPROM 74.

Subsequently, the controller 70 performs a driving-potential determining process (S404). In the first modification, the controller 70 performs processes of S405 to S408 that are similar to S105 to S108.

Figure 12:
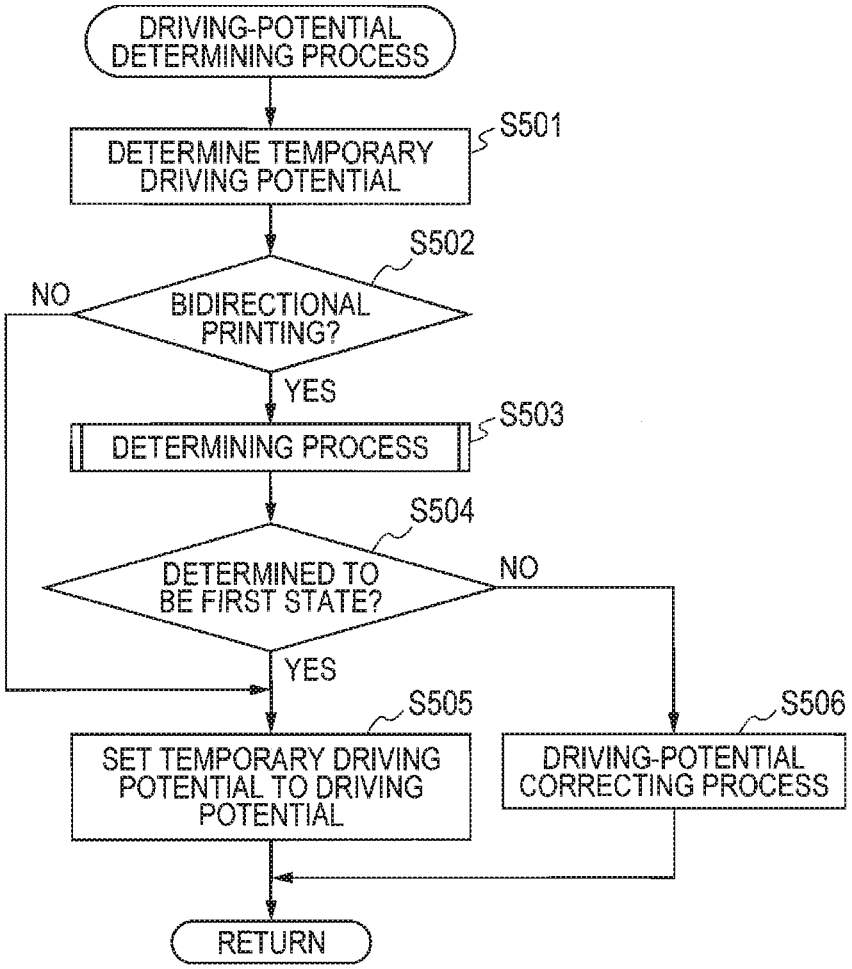
FIG. 12 is a flowchart showing a flow of a driving-potential determining process of FIG. 11.

As shown in FIG. 12, in the driving-potential determining process of S404, the controller 70 first determines a temporary driving potential (S501). The EEPROM 74 preliminarily stores a table in which the thermistor temperature Ts and the temporary driving potential are associated with each other. In S501, the temporary driving potential is determined based on this table. The temporary driving potential determined in S501 is, for example, the same as the driving potential determined in the driving-potential determining process of S103 of the above-described embodiment.

Subsequently, the controller 70 determines whether bidirectional printing is performed or unidirectional printing is performed similarly to S201 of the above-described embodiment (S502). When bidirectional printing is performed (S502: Yes), the controller 70 subsequently performs a determining process similar to S203 of the above-described embodiment (S503).

When it is determined that it is in the first state in S503 (S504: Yes), the controller 70 sets the temporary driving potential to the driving potential V in scan printing as it is (S505). That is, correction for the temporary driving potential is not performed.

On the other hand, when it is determined that it is in the second state in S503 (S504: No), the controller 70 performs a driving-potential correcting process for correcting the temporary driving potential (S506). Thereby, the corrected driving potential obtained by correcting the temporary driving potential is determined as the driving potential V in scan printing. When unidirectional printing is performed (S502: No), the controller 70 sets the temporary driving potential to the driving potential V in scan printing as it is (S505). The driving-potential correcting process is an example of a correcting process and an ejection-speed correcting process.

Assume that, in the second state, the driving potential is determined based on the thermistor temperature Ts and that the plurality of drive elements 50 is driven by the driving potential. In this case, the ejection speed of ink ejected from the nozzles 45 is not the same as the ejection speed at the time when the driving potential is determined based on the thermistor temperature Ts in the first state. Therefore, the droplet landing position of ink ejected from the nozzles 45 in scan printing is deviated in the scanning direction. As a result, similar to above, deviation in the scanning direction is generated at the joint between the image G1 (see FIG. 8A) printed in scan printing in which the carriage 2 is moved to the right side and the image G2 (see FIG. 8A) printed in scan printing in which the carriage 2 is moved to the left side. In the first modification, when bidirectional printing is performed, in the second state, the temporary driving potential is corrected. Thereby, the ejection speed of ink ejected from the nozzles 45 is corrected and the deviation can be suppressed.

In the first modification, the ejection speed of ink ejected from the nozzles 45 is corrected by correcting the driving potential. However, the correction is not limited to this. For example, the ejection speed of ink ejected from the nozzles 45 may be corrected by correcting a driving waveform for driving the drive elements 50. The process of correcting a driving waveform is an example of the correcting process and the ejection-speed correcting process.

Figure 13:
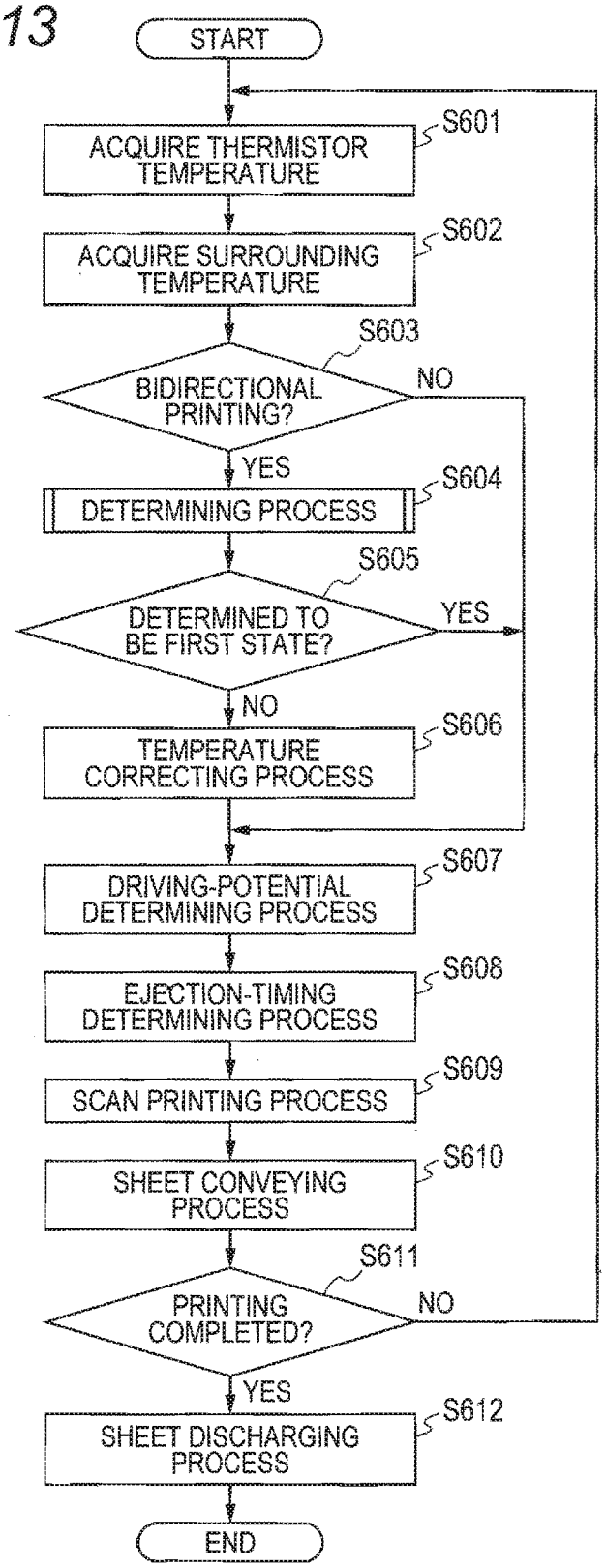
FIG. 13 is a flowchart showing a flow of processes in printing according to a second modification.

As shown in FIG. 13, in a second modification, the controller 70 acquires the thermistor temperature Ts (S601) and acquires the surrounding temperature Te (S602) similarly to S101 and S102 of the above-described embodiment. Subsequently, when unidirectional printing is performed (S603: No), the controller 70 directly proceeds to S607.

On the other hand, when bidirectional printing is performed (S603: Yes), the controller 70 subsequently performs a determining process similar to S203 (S604). When it is determined that it is in the first state in S604 (S605: Yes), the controller 70 proceeds to S607. When it is determined that it is in the second state in S604 (S605: No), the controller 70 performs a temperature correcting process (an example of a correcting process) for correcting the thermistor temperature Ts acquired in S601 (S606), and then proceeds to S607.

In S607, the controller 70 performs a driving-potential determining process that is similar to S103 of the above-described embodiment. Subsequently, the controller 70 performs an ejection-timing determining process that is similar to S403 of the first modification (S608). Thereby, when unidirectional printing is performed, and when bidirectional printing is performed and it is in the first state, the driving potential and the ejection timing in scan printing is determined in S607 and S608 based on the thermistor temperature Ts acquired in S601. On the other hand, when bidirectional printing is performed and it is in the second state, the driving potential or the ejection timing in scan printing is determined based on the thermistor temperature corrected in S606.

In the second modification, the controller 70 performs processes of S609 to S612 that are similar to S105 to S108.

Here, assume that, when bidirectional printing is performed and it is in the second state, the driving potential and the ejection timing in scan printing are determined based on the thermistor temperature Ts acquired in S601. In this case, deviation in the scanning direction is generated at the joint between the image G1 (see FIG. 8A) printed in scan printing in which the carriage 2 is moved to the right side and the image G2 (see FIG. 8A) printed in scan printing in which the carriage 2 is moved to the left side, as described above. Accordingly, in the second modification, when bidirectional printing is performed and it is in the second state, the acquired thermistor temperature Ts is corrected and the driving potential and the ejection timing in scan printing are determined based on the corrected thermistor temperature. Thereby, the deviation can be suppressed.

In the above-described embodiment, as the surrounding temperature Te is lower, the threshold value R to be compared with the temperature difference $\Delta T$ is made larger. However, the threshold value R is not limited to this. For example, the threshold value R may be a fixed value irrespective of the surrounding temperature Te. In this case, the threshold value R is, for example, a threshold value corresponding to the surrounding temperature Te that is assumed in a normal use of the printer 1.

In the above-described embodiment, in the wiring member 64, the length L1 of the part between the driver IC 62 and the thermistor 65 is longer than the length L2 of the part between the driver IC 62 and the inkjet head 3. However, the relationship of the lengths is not limited to this. The length L1 may be equal to or shorter than the length L2.

In the above-described embodiment, the thermistor 65 is located at the opposite side from the inkjet head 3 with respect to the driver IC 62. However, the position of the thermistor 65 is not limited to this. The thermistor 65 may be located at the same side as the inkjet head 3 with respect to the driver IC 62.

In these cases, too, the way of heat transmission from the driver IC 62 to the inkjet head 3 and the way of heat transmission from the driver IC 62 to the thermistor 65 differ. Thus, when the plurality of drive elements 50 is driven by the driver IC 62, there is a period in the second state before it becomes the first state.

In the above-described embodiment, the information on the amount of correction U is stored in the EEPROM 74. However, the method of obtaining the amount of correction U is not limited to this. For example, the controller 70 may calculate the amount of correction U from the thermistor temperature Ts and the surrounding temperature Te each time it is needed.

In the above-described embodiment, as the surrounding temperature Te is lower, the amount of correction U of ejection timing in bidirectional printing is made larger. However, the amount of correction U is not limited to this. For example, the amount of correction U of ejection timing in bidirectional printing may be such an amount that decreases as the temperature difference ΔT2 increases but that does not vary depending on the surrounding temperature Te. The amount of correction U in this case is, for example, an amount of correction corresponding to the surrounding temperature Te that is assumed in a normal use of the printer 1.

In the above-described embodiment, whether it is in the first state or in the second state is determined based on the temperature difference ΔT and the surrounding temperature Te. However, the method of determination is not limited to this. As described above, when the plurality of drive elements 50 is driven by the driver IC 62, there is a period of the second state and, after the temperature of the inkjet head 3 increases to some extent, it is in the first state.

Hence, for example, it may be determined that it is in the second state when the thermistor temperature Ts is lower than a particular threshold value, and that it is in the first state when the thermistor temperature Ts is equal to or higher than the threshold value. In this case, the thermistor temperature Ts is an example of a particular parameter.

Alternatively, a timer for measuring elapsed time from start of driving of the plurality of the drive elements 50 by the driver IC 62 may be provided in the printer 1. And, it may be determined that it is in the second state when the elapsed time measured by the timer is shorter than a particular period, and that it is in the first state when the elapsed time is equal to or longer than the particular period. In this case, the elapsed time from start of driving of the drive elements 50 is an example of the particular parameter.

In the above-described embodiment, it is determined to be in the first state when the temperature difference ΔT1 between the thermistor temperature Ts and the head temperature Th is constant, and it is determined to be in the second state when the temperature difference ΔT1 varies with time. However, determination of the first state and the second state is not limited to this.

As the above-described embodiment, the state where the temperature difference between the thermistor temperature Ts and the temperature in a part of the inkjet head is substantially constant (varies only in a range of ±1 degree Celsius or less) may be determined to be the first state. Alternatively, in a case where there is a temperature difference to some extent between a plurality of parts of the inkjet head, the state where the thermistor temperature becomes substantially equal to an average value of the temperature of the plurality of parts may be determined to be the first state.

Figure 14A:
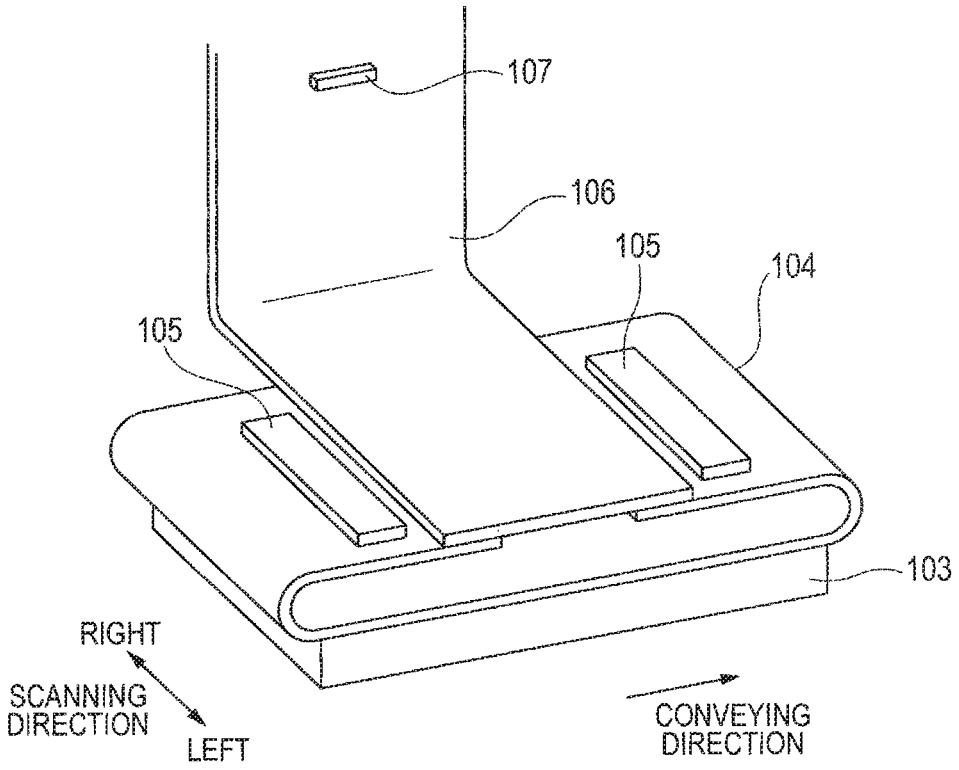
FIG. 14A is a perspective view showing a schematic configuration of an inkjet head according to a third modification.

For example, in a third modification, as shown in FIG. 14A, an inkjet head 103 is longer than the inkjet head 3 in the conveying direction and has a larger number of the nozzles 45 (see FIG. 2) forming the nozzle array 37 (see FIG. 2). A COF 104 (an example of a first connecting member) arranged on the upper surface of the inkjet head 103 extends to the both sides in the conveying direction from the inkjet head 103, and the both sides are bent slightly upward and are bent toward inside in the conveying direction. Thereby, two end portions of the COF 104 are located substantially directly above the inkjet head 103 and are separated from each other in the conveying direction. A driver IC 105 is formed on each of the two end portions of the COF 104. The driver IC 105 at the upstream side in the conveying direction is for driving the drive elements 50 (see FIG. 2) corresponding to about a half number of the nozzles 45 at the upstream side among the plurality of nozzles 45 forming each nozzle array 37. The driver IC 105 at the downstream side in the conveying direction is for driving the drive elements 50 (see FIG. 2) corresponding to about a half number of the nozzles 45 at the downstream side among the plurality of nozzles 45 forming each nozzle array 37. A common FPC 106 (an example of a second connecting member) is connected to the top surface of the two end portions of the COF 104. The FPC 106 extends to the right side in the scanning direction from the connection portion with the COF 104 and is bent upward. A thermistor 107 is arranged on a portion of the FPC 106 extending vertically. The thermistor 107 is arranged at such a position that the distance between the thermistor 107 and the driver IC 105 at the upstream side is the same as the distance between the thermistor 107 and the driver IC 105 at the downstream side.

In this case, heat generated by two driver ICs 105 is each transmitted to the inkjet head 103 and to the thermistor 107. In the inkjet head 103, ink flows into the manifold channel 41 (see FIG. 2) from the ink supply port 38 formed in the end portion of the upstream side in the conveying direction. The ink having flowed into the manifold channel 41 flows from the upstream side to the downstream side in the conveying direction in the manifold channel 41. At this time, the inkjet head 103 is cooled by ink near the ink supply port 38 of the manifold channel 41 in the end portion at the upstream side in the conveying direction. Ink in the manifold channel 41 is heated by the inkjet head 103 when the ink flows from the upstream side to the downstream side in the conveying direction. Therefore, the end portion of the inkjet head 103 at the downstream side in the conveying direction is hard to be cooled by ink in the manifold channel 41. Therefore, as shown in FIG. 14B, a head temperature Th2 of the end portion of the inkjet head 103 at the downstream side in the conveying direction becomes higher than a head temperature Th1 of the end portion at the upstream side.

Figure 14B:
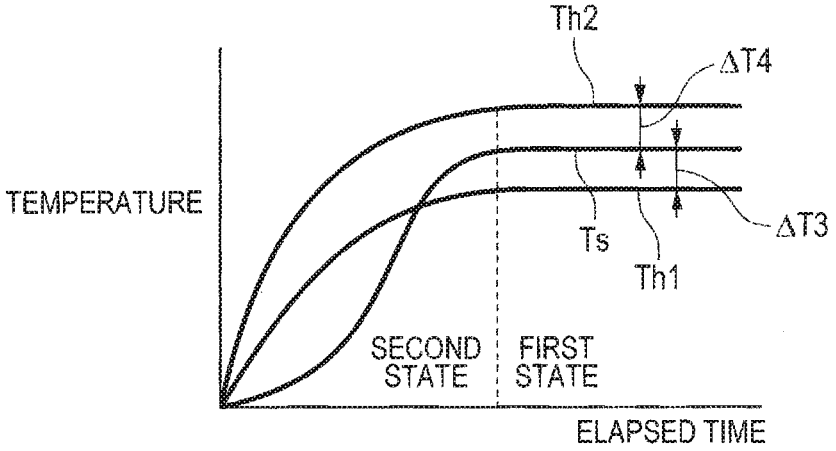
FIG. 14B is a diagram showing a relationship between elapsed time from start of driving of drive elements, and a thermistor temperature and actual temperatures of upstream and downstream end portions of the inkjet head in a conveying direction according to the third modification.

In the third modification, when the plurality of drive elements 50 (see FIG. 3) is continued to be driven by two driver ICs 105, as shown in FIG. 14B, it eventually becomes the first state where the thermistor temperature Ts is substantially equal to the average value of the upstream-side head temperature Th1 that is a temperature in the end portion of the inkjet head 103 at the upstream side in the conveying direction and the downstream-side head temperature Th2 that is a temperature of the end portion at the downstream side. That is, a temperature difference ΔT3 between the thermistor temperature Ts and the upstream-side head temperature Th1 and a temperature difference ΔT4 (=ΔT3) between the thermistor temperature Ts and the downstream-side head temperature Th2 are constant. On the other hand, a period from start of driving of the drive elements 50 until becoming the first state is a period of the second state where the thermistor temperature Ts is deviated from the average value of the upstream-side head temperature Th1 and the downstream-side head temperature Th2, because the temperature differences ΔT3 and ΔT4 vary with time. In this case, too, similar to the relationship shown in FIG. 8B, there is a relationship, for each surrounding temperature Te, between the amount of deviation Q and the temperature difference between the thermistor temperature Ts and the surrounding temperature Te. Therefore, in this case, too, if it is in the second state when bidirectional printing is performed, it is preferable to correct ejection timing or a driving potential (ejection speed), or to correct thermistor temperature and determine ejection timing and a driving potential based on the corrected thermistor temperature, as described above.

In the above-described embodiment, this disclosure is applied to the printer having the inkjet head that eject ink from the nozzles communicating with the pressure chambers by deforming the vibration plate and the piezoelectric layer of the piezoelectric actuator to increase the pressure of ink in the pressure chambers. In this printer, the driver IC driving the piezoelectric actuators serves as a heat generator. However, this disclosure may be applied to another type of printer. For example, this disclosure may be applied to a printer including an inkjet head in which a heater for ejection is individually arranged for an ejection port of ink, as disclosed in Japanese Patent Application Publication No. 2016-43634. In this printer, the heater for ejection generates heat so that ink on the heater bubbles, and ink is ejected from the ejection port. In this case, the heater for ejection serves as a heat generator.

In the above-described embodiment, this disclosure is applied to the inkjet printer including a so-called serial head for printing by ejecting ink from the inkjet head while moving, in the scanning direction, the carriage on which the inkjet head is mounted. However, this disclosure may be applied to an inkjet printer having a so-called line head that is an inkjet head extending over an entire length in a direction perpendicular to the conveying direction of a recording sheet. In the inkjet printer having the line head, printing is performed by ejecting ink from the line head, while the recording sheet is conveyed. If, in the second state, ink is ejected at the ejection timing determined to be suitable in the first state, the droplet landing position of ink is deviated in the conveying direction. Therefore, in the inkjet printer having the line head, it is also effective to determine whether it is in the first state or in the second state and, when it is in the second state, to correct the ejection timing or the ejection speed. Alternatively, it is effective to determine whether it is in the first state or in the second state and, when it is in the second state, to correct the temperature detected by the thermistor and to determine the ejection timing or the ejection speed based on the corrected temperature.

Further, this disclosure can be applied to a printer that performs printing by ejecting liquid other than ink, such as a wiring pattern material to be printed on a wiring board.

What is claimed is:

1. A printer comprising:

a liquid ejection head having a plurality of nozzles, the liquid ejection head having a plurality of drive elements configured to cause the plurality of nozzles to eject liquid;

a heat generator;

a first temperature sensor configured to detect a temperature of the liquid ejection head;

a second temperature sensor configured to detect a temperature near the liquid ejection head; and a controller, wherein the heat generator generates heat when the plurality of drive elements is driven; and wherein the controller is configured to:

perform a determining process of determining whether the printer is in a first state or in a second state based on a temperature difference between the temperature detected by the first temperature sensor and the temperature detected by the second temperature sensor, the first state being a state where a difference between the temperature detected by the first temperature sensor and an actual temperature of the liquid ejection head is constant, the second state being a state where the difference between the temperature detected by the first temperature sensor and the actual temperature of the liquid ejection head varies with time; and control the plurality of drive elements based on a determination result in the determining process.

2. The printer according to claim 1, wherein the controller is configured to further perform a threshold-value setting process of setting a threshold value used for comparison with the temperature difference; and wherein the controller is configured to:

in the threshold-value setting process, set the threshold value to a larger value as the temperature detected by the second temperature sensor is lower; and in the determining process, determine that the printer is in the first state when the temperature difference is equal to or larger than to the threshold value, and determine that the printer is in the second state when the temperature difference is smaller than the threshold value.

3. The printer according to claim 1, wherein the controller is configured to further perform a correcting process of, in response to determining that the printer is in the second state, correcting droplet landing positions of liquid ejected from the plurality of nozzles, the droplet landing positions being positions where droplets land on a recording medium.

4. The printer according to claim 3, wherein the controller is configured to:

determine an ejection speed of ejecting liquid from the plurality of nozzles, based on the temperature detected by the first temperature sensor;

determine a temporary ejection timing of ejecting liquid from the plurality of nozzles; and perform, as the correcting process, an ejection-timing correcting process of correcting the temporary ejection timing.

5. The printer according to claim 3, wherein the controller is configured to:

perform, as the correcting process, a temperature correcting process of correcting the temperature detected by the first temperature sensor; and control the plurality of drive elements to eject liquid from the plurality of nozzles based on the temperature corrected in the temperature correcting process.

6. The printer according to claim 3, wherein the controller is configured to:

determine an ejection timing of ejecting liquid from the plurality of nozzles;

determine a temporary ejection speed of ejecting liquid from the plurality of nozzles; and perform, as the correcting process, an ejection-speed correcting process of correcting the temporary ejection speed.

7. The printer according to claim 3, further comprising:

a conveyor configured to convey a recording medium in a conveying direction, the plurality of nozzles being arranged in the conveying direction; and a head moving device configured to move the liquid ejection head in a scanning direction intersecting the conveying direction, wherein, when bidirectional printing is performed by controlling the liquid ejection head and the head moving device, the controller is configured to perform the correcting process in response to determining that the printer is in the second state.

8. The printer according to claim 7, wherein the controller is configured not to perform the correcting process in response to determining that the printer is in the first state.

9. The printer according to claim 3, wherein the heat generator generates a larger amount of heat as the plurality of drive elements applies a larger amount of ejection energy to liquid in the plurality of nozzles; and wherein the controller is configured to, as the temperature detected by the second temperature sensor is lower:

control the plurality of drive elements to apply a larger amount of ejection energy; and perform the correcting process such that an amount of correction is larger.

10. The printer according to claim 3, further comprising a memory configured to store correction information relating to an amount of correction used in the correcting process, wherein the controller is configured to, in the correcting process, perform correction by using the correction information stored in the memory.

11. The printer according to claim 10, further comprising:

wherein the correction information includes a table in which an amount of correction of ejection timing is associated with the temperature difference and the temperature detected by the second temperature sensor;

wherein the amounts of correction are set such that:

when the temperature detected by the second temperature sensor is same, the smaller the temperature difference is, the larger the amount of correction is; and when the temperature difference is same, the lower the temperature detected by the second temperature sensor is, the larger the amount of correction is.

12. The printer according to claim 1, further comprising a connecting member that connects the liquid ejection head, the heat generator, and the first temperature sensor, wherein the first temperature sensor is arranged at an opposite side from the liquid ejection head with respect to the heat generator in a direction in which the connecting member extends.

13. The printer according to claim 12, wherein a length of a portion of the connecting member between the heat generator and the first temperature sensor is longer than a length of another portion of the connecting member between the liquid ejection head and the heat generator.

14. The printer according to claim 12, wherein the connecting member comprises:

a first connecting member that is arranged on a surface of the liquid ejection head and that extends from upstream and downstream end portions of the liquid ejection head in a conveying direction in which a recording medium is conveyed, thereby forming both end portions; and a second connecting member having one end connected to the both end portions of the first connecting member and another end connected to the controller;

wherein the heat generator comprises:

a first driver IC arranged on one of the both end portions of the first connecting member and configured to drive the plurality of drive elements corresponding to a half number of the plurality of nozzles at an upstream side in the conveying direction; and a second driver IC arranged on another one of the both end portions of the first connecting member and configured to drive the plurality of drive elements corresponding to a half number of the plurality of nozzles at a downstream side in the conveying direction; and wherein the first temperature sensor is arranged on the second connecting member at a position where a distance between the first temperature sensor and the first driver IC is same as a distance between the first temperature sensor and the second driver IC, so that, in the first state, the temperature detected by the first temperature sensor is substantially equal to an average value of an upstream-side head temperature that is a temperature in the upstream end portion of the liquid ejection head and a downstream-side head temperature that is a temperature in the downstream end portion of the liquid ejection head.

15. The printer according to claim 1, further comprising a timer configured to measure elapsed time from start of driving of the plurality of the drive elements, wherein the determining process comprises determining whether the printer is in the first state or in the second state based on the elapsed time.

16. The printer according to claim 1, wherein the first temperature sensor is arranged on a wiring member connecting the liquid ejection head and the controller; and wherein the second temperature sensor is arranged on a member provided in a main casing of the printer such that the second temperature sensor and the liquid ejection head have a space therebetween, the second temperature sensor detecting an air temperature near the liquid ejection head.

17. A printer comprising:

a liquid ejection head having a plurality of nozzles, the liquid ejection head having a plurality of heaters configured to generate heat so that liquid on the plurality of heaters bubbles and to cause the plurality of nozzles to eject liquid, the plurality of heaters respectively arranged for the plurality of nozzles;

a first temperature sensor configured to detect a temperature of the liquid ejection head;

a second temperature sensor configured to detect a temperature near the liquid ejection head; and a controller configured to:

perform a determining process of determining whether the printer is in a first state or in a second state based on a temperature difference between the temperature detected by the first temperature sensor and the temperature detected by the second temperature sensor, the first state being a state where a difference between the temperature detected by the first temperature sensor and an actual temperature of the liquid ejection head is constant, the second state being a state where the difference between the temperature detected by the first temperature sensor and the actual temperature of the liquid ejection head varies with time; and control the plurality of heaters based on a determination result in the determining process.

* * * * *